US011287141B2

(12) United States Patent
Trice et al.

(10) Patent No.: US 11,287,141 B2
(45) Date of Patent: Mar. 29, 2022

(54) ARTICULATING RACK FOR A COOKING APPLIANCE

(71) Applicant: Midea Group Co., Ltd., Foshan (CN)

(72) Inventors: Daniel J. Trice, Louisville, KY (US); Nathan E. Nelson, Louisville, KY (US)

(73) Assignee: MIDEA GROUP CO., LTD., Guangdong (CN)

( * ) Notice: Subject to any disclaimer, the term of this patent is extended or adjusted under 35 U.S.C. 154(b) by 191 days.

(21) Appl. No.: 16/587,600

(22) Filed: Sep. 30, 2019

(65) Prior Publication Data

US 2021/0095863 A1 Apr. 1, 2021

(51) Int. Cl.
*F24C 15/16* (2006.01)

(52) U.S. Cl.
CPC ..... *F24C 15/16* (2013.01)

(58) Field of Classification Search
CPC ..... F24C 15/16; A47L 15/504; A47L 15/506; A47B 46/00; A47B 46/005; A47B 2088/901; A47B 2200/0041; B66F 7/0641
See application file for complete search history.

(56) References Cited

U.S. PATENT DOCUMENTS 1,491,781 A * 4/1924 Axen ..... A47B 21/02 312/27
1,796,033 A * 3/1931 Lee ..... F24B 1/202 126/9 R
2,201,179 A * 5/1940 Jackson ..... B66F 7/0641 254/91
2,212,940 A * 8/1940 Makaroff ..... B66F 7/0641 254/91
2,242,433 A * 5/1941 Makaroff ..... B66F 7/0641 254/91
2,340,764 A * 2/1944 Makaroff ..... B66F 7/08 254/91
2,398,949 A * 4/1946 Mcclain ..... E04G 1/18 182/13
2,585,566 A * 2/1952 Brynolf ..... A47B 21/02 312/27
2,678,862 A * 5/1954 Paliuca ..... A47B 21/02 312/28
2,738,247 A * 3/1956 Hutzelman ..... A47B 21/02 312/27
2,744,805 A * 5/1956 Mcmahan ..... A47B 77/12 312/27

(Continued)

FOREIGN PATENT DOCUMENTS

CN 1689492 A 11/2005
CN 102170814 A 8/2011

(Continued)

OTHER PUBLICATIONS

International Search Report and The Written Opinion of the International Searching Authority issued in PCT Application No. PCT/CN2020/097576, dated Sep. 8, 2020.

*Primary Examiner* — Jorge A Pereiro
(74) *Attorney, Agent, or Firm* — Middleton Reutlinger

(57) ABSTRACT

An apparatus and method of articulating a rack for a cooking appliance between a lowered position and a raised position. One or more cams drive one or more linkage members pivotably connected to the rack. One or more drive mechanisms may be used to pivot the one or more cams.

19 Claims, 8 Drawing Sheets

(56) References Cited

U.S. PATENT DOCUMENTS 2,822,229 A * 2/1958 Carlson ..... A47B 77/12 312/27
2,897,812 A 8/1959 Albrecht
2,919,966 A * 1/1960 Preston ..... A47F 3/06 312/27
3,059,634 A 10/1962 Brinkman et al.
3,761,153 A 9/1973 Guth
4,396,344 A * 8/1983 Sugimoto ..... B25J 9/046 414/706
5,447,146 A * 9/1995 Nickerson ..... F24C 15/16 126/332
5,526,734 A 6/1996 Harrison
6,109,154 A * 8/2000 Miyatsu ..... B26D 1/085 83/202
6,557,544 B2 5/2003 Sim
7,064,296 B1 6/2006 Harned et al.
7,439,454 B2 * 10/2008 Komatsu ..... B65G 27/08 177/119
7,621,605 B2 11/2009 Bond et al.
9,629,454 B2 * 4/2017 Bunch ..... A47B 51/00
9,788,649 B2 * 10/2017 Bunch ..... A47B 51/00
9,961,991 B1 * 5/2018 Chen ..... A47B 9/16
10,561,235 B1 * 2/2020 Abbott ..... A47B 46/005
2005/0206282 A1 * 9/2005 Walburn ..... A47B 46/005 312/312
2005/0254925 A1 * 11/2005 Braquet ..... B60P 1/4414 414/462
2006/0066189 A1 * 3/2006 Bond ..... A47B 88/90 312/319.1
2006/0102015 A1 5/2006 Baker et al.
2007/0019106 A1 * 1/2007 Ibaraki ..... F16M 11/18 348/373
2007/0035220 A1 * 2/2007 Bond ..... A47L 15/506 312/319.1
2008/0129168 A1 * 6/2008 Banta ..... A47L 15/506 312/333
2008/0309211 A1 12/2008 Wilson et al.
2009/0229890 A1 * 9/2009 Sugioka ..... B65G 27/32 177/59
2010/0045152 A1 * 2/2010 Bond ..... A47B 46/005 312/319.1
2011/0203567 A1 8/2011 Yeh
2012/0074080 A1 * 3/2012 Garcia ..... F24C 15/168 211/41.9
2014/0001425 A1 * 1/2014 Falcon ..... A47B 77/12 254/133 R
2014/0263122 A1 * 9/2014 Roberts ..... A47B 51/00 211/88.01
2016/0331205 A1 * 11/2016 Gerstner ..... A47L 15/506
2016/0331206 A1 * 11/2016 Gerstner ..... A47L 15/506
2017/0027413 A1 * 2/2017 Gerstner ..... A47L 15/506
2017/0143118 A1 * 5/2017 Azkue ..... A47L 15/504
2017/0181538 A1 * 6/2017 Azkue ..... F24C 15/168
2017/0224190 A1 * 8/2017 Sakthivel ..... A47L 15/506
2017/0273538 A1 * 9/2017 Kulkarni ..... A47L 15/506
2021/0121042 A1 * 4/2021 Heinle ..... A47L 15/507

FOREIGN PATENT DOCUMENTS

CN 205682984 U 11/2016
CN 207245580 U 4/2018
CN 109199301 A * 1/2019
WO WO-2008072729 A1 * 6/2008 ..... A47B 51/00

* cited by examiner

ARTICULATING RACK FOR A COOKING APPLIANCE

BACKGROUND

The present embodiments relate to an articulating rack integrated into a cooking appliance, and particularly, but not limited to, for a gas and/or electric cooking appliance.

Typical cooking appliances with oven racks involve a wire oven rack stowed and deployed in a single horizontal plane relative to the cooking compartment. Without a change in elevation in the wire oven rack, the user is required to bend down to place and retrieve heavy baking dishes and/or food items from the cooking compartment. Thus, there is a need for, but is not limited to, an apparatus and method to change the elevation of an oven rack to provide easier access to unload/load food items into and out the cooking compartment.

SUMMARY

In some embodiments, a cooking appliance may include a cooking compartment defined by opposing side walls. In various embodiments, the cooking appliance may include a first drive shaft extending through at least one of the side walls, wherein the first drive shaft may include a first cam. In addition, in some embodiments, the cooking appliance may include a plurality of first linkage members pivotably connecting at least one side wall of the opposing side walls to a wire rack. In some embodiments, the plurality of first linkage members and the wire rack may be positionable between a lowered position within the cooking compartment and a raised position deployed from the cooking compartment. In various embodiments, the cooking appliance may include a motor rotating the first drive shaft to pivot the first cam against at least one first linkage member of the plurality of first linkage members to pivot the wire rack and the plurality of first linkage members to the raised position.

In addition, in some embodiments, at least one first linkage member may include a first cam receiving surface and a pivot axis, wherein the first cam receiving surface may be spaced from the pivot axis. In various embodiments, the first cam may be spaced radially outward from a rotational axis of the first drive shaft. In some embodiments, the cooking appliance may include a first lever arm and a second lever arm interconnected by a first cable, wherein the second lever arm may be secured to the first drive shaft, and wherein the motor pivots the first lever arm pulling the first cable with the second lever arm following to rotate the first drive shaft. In various embodiments, the second lever arm and the first lever arm may pivot in opposing rotational directions. In addition, in various embodiments, the cooking appliance may include a second drive shaft extending through another side wall of the opposing side walls, wherein the second drive shaft may include a second cam. In some embodiments, the cooking appliance may include a plurality of second linkage members pivotably connecting the other side wall of the opposing side walls to the wire rack, and wherein the plurality of second linkage members and the wire rack may be positionable between the lowered position within the cooking compartment and the raised position deployed from the cooking compartment. In addition, in some embodiments, the motor rotating the second drive shaft may pivot the second cam against at least one second linkage member of the plurality of second linkage members to pivot the wire rack and the plurality of second linkage members to the raised position. Moreover, in some embodiments, the cooking appliance may include a third lever arm secured to the second drive shaft and connected to the first lever arm by a second cable, and wherein the motor pivots the first lever arm pulling the second cable with the third lever arm following to rotate the second drive shaft.

In some embodiments, a cooking appliance may include a cooking compartment having a rack positionable between a lowered positioned within the cooking compartment and a raised position deployed from the cooking compartment. In various embodiments, the cooking appliance may include at least one motor. In some embodiments, the cooking appliance may include one or more linkage members pivotably coupled to the rack. Moreover, in some embodiments, the cooking appliance may include at least one drive shaft extending through a side wall of the cooking compartment and having an outside end and an inside end, wherein the inside end may include a cam and the outside end may include a lever arm. In various embodiments, at least one motor may pivot the lever arm and the cam about a rotational axis of at least one drive shaft. In some embodiments, the cam may engage at least one linkage member of one or more linkage members thereby pivoting one or more linkage members and the rack to the raised position.

In addition, in some embodiments, the cooking appliance may include at least one limit switch to signal at least one position of the rack. In various embodiments, the cooking appliance may include a clutch locking the rack in the raised positon. In various embodiments, the cooking appliance may include a cable connecting at least one motor with the lever arm, wherein the cable may pivot the lever arm. Moreover, in some embodiments, at least one linkage member may include a cam receiving surface and a pivot axis, wherein the cam receiving surface may be spaced from the pivot axis. In various embodiments, the cooking appliance may include more than one of the drive shafts.

Further, in some embodiments, an oven rack system for a cooking appliance may include an oven rack. In various embodiments, the oven rack system may include one or more linkage members pivotably coupled to the oven rack. In some embodiments, at least one linkage member may include a cam receiver. Moreover, in various embodiments, the oven rack system may include a cam pivoting against the cam receiver of at least one linkage member to pivot the oven rack between a stowed position and a deployed position, wherein the stowed position may be lower than the deployed position.

In addition, in some embodiments, at least one linkage member may include a pivot axis, and wherein the pivot axis may be positioned between the cam receiver and the oven rack. In various embodiments, the oven rack system may include a drive shaft having the cam at one end and a lever arm positioned at an opposing end. Moreover, in some embodiments, the drive shaft may include a radially extending arm at the one end, wherein the cam may be spaced radially outward from a rotational axis of the drive shaft. In various embodiments, the oven rack system may include one or more cables, one or more lever arms, and/or one or more pulleys connecting at least one motor to pivot the cam. In some embodiments, the cam may be cylindrical in shape. In some embodiments, the cam receiver may be a slot within an outer periphery of at least one linkage member.

These and other advantages and features, which characterize the embodiments, are set forth in the claims annexed hereto and form a further part hereof. However, for a better understanding of the embodiments, and of the advantages and objectives attained through its use, reference should be made to the Drawings and to the accompanying descriptive matter, in which there is described example embodiments. This summary is merely provided to introduce a selection of concepts that are further described below in the detailed description, and is not intended to identify key or essential features of the claimed subject matter, nor is it intended to be used as an aid in limiting the scope of the claimed subject matter.

BRIEF DESCRIPTION OF THE DRAWINGS

In the drawings, like reference characters generally refer to the same parts throughout the different views. Also, the drawings are not necessarily to scale, emphasis instead generally being placed upon illustrating the principles of the invention.

DETAILED DESCRIPTION

Numerous variations and modifications will be apparent to one of ordinary skill in the art, as will become apparent from the description below. Therefore, the invention is not limited to the specific implementations discussed herein.

Figure 1:
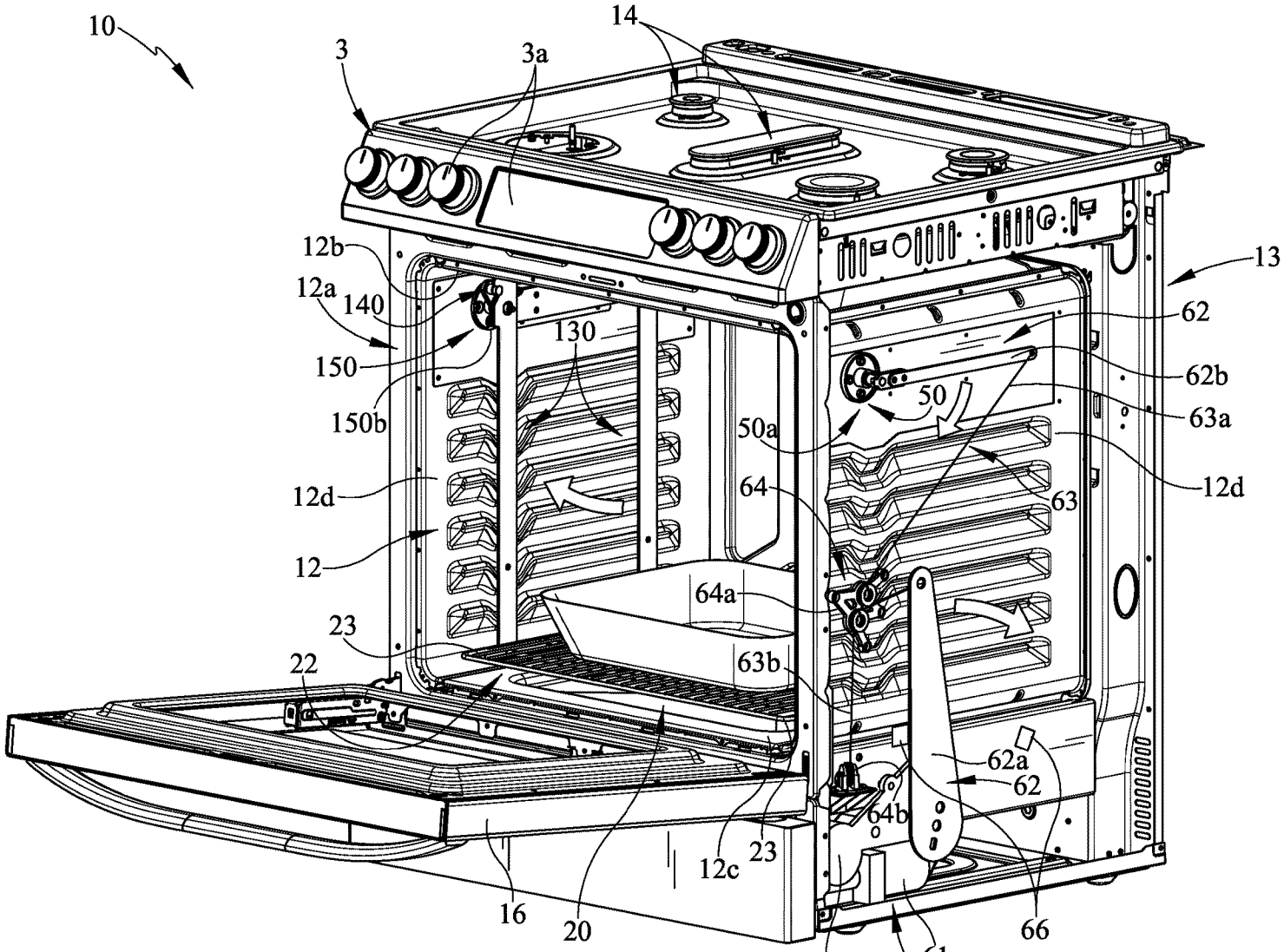
FIG. 1 is a perspective view of one embodiment of a rack of a cooking appliance illustrating the lowered rack in a stowed position of the cooking appliance.
Figure 6:
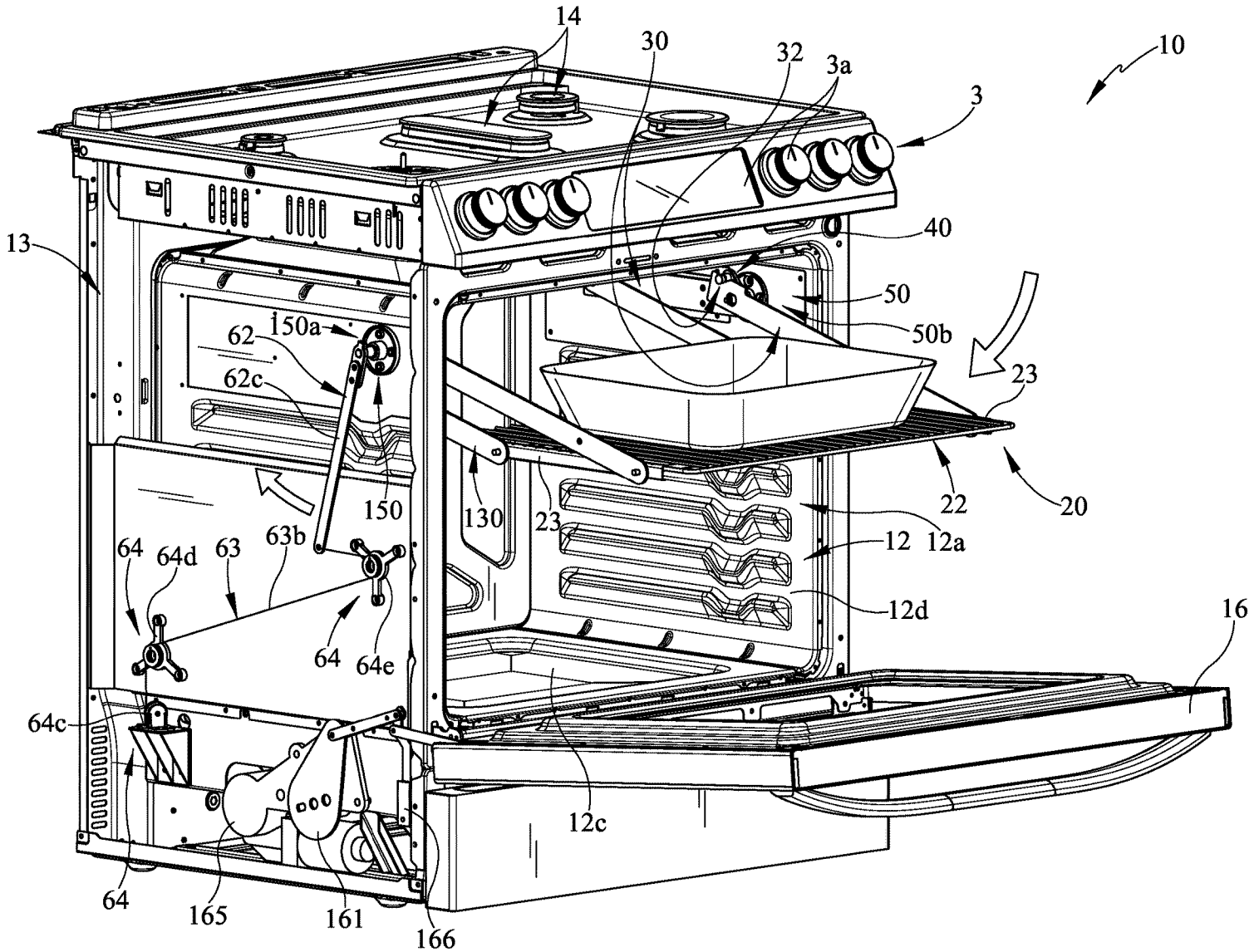
FIG. 6 is another perspective view of the embodiment of FIG. 1 when in the raised position.

As illustrated in the Figures, one or more oven racks 20 may be used in a variety of cooking appliances 10 to raise and/or lower one or more oven/wire racks 20 relative to the remaining cooking compartment 12. The rack 20 may have an outer periphery 22 or sides/edges 23 pivotable engaging one or more sides or side walls 12*d* of the cooking compartment or cavity 12. One or more linkage arms or members 30 may pivotably connect the rack 20 (e.g. opposing sides) to the side walls 12*d* or other portions of the compartment 12 or appliance 10. The rack 20 may pivot or swing from a lowered position (e.g. FIG. 1 or stowed) within the compartment 12 to a raised position (e.g. FIGS. 2 and 6 or deployed) from or forward of the front opening 12*a*. A door 16 defines at least a portion of the front opening 12*a* into the cooking compartment 12. The door 16 is positionable between a closed and opened position. The door 16 is typically on the front side of the appliance 10 and may be positioned above a warming drawer, if used. Although the extending rack 20 is shown as across the entire front opening 12*a* into the compartment 12, it should be understood that the extending rack 20 may extend across a portion of one or more cooking compartments 12 or opening 12*a*. Although one rack 20 is shown in FIG. 1, a plurality of racks may be used within the compartment 12. For example, in some embodiments, one or more upper racks may be removed to allow the rack 20 to be raised and lowered between positions.

In some implementations, the cooking appliance 10 may include a cooktop on a top of the housing 13. The cooking appliance 10 may further include a control panel 3 having a plurality of control knobs, controls, or user interface 3*a* for controlling the gas and/or electric burners 14, if a range used, cooking compartment 12, and/or oven rack 20. The embodiments discussed hereinafter will focus on the implementation of the hereinafter-described techniques and apparatuses within a residential cooking appliance such as cooking appliance 10, such as the type that may be used in single-family or multi-family dwellings, or in other similar applications. It will be appreciated that the herein-described techniques and apparatuses may also be used in connection with other types of cooking appliances in some embodiments. For example, the herein-described techniques may be used in commercial applications in some embodiments. Moreover, the herein-described techniques may be used in connection with various cooking appliance configurations. Implementation of the herein-described techniques within oven burners, broil burner, gas and/or electric range, slide-in oven, freestanding oven, wall oven, gas and/or electric cooktop, gas countertop range, cooking appliances with front or rear controls, etc. using a articulating rack would be well within the abilities of one of ordinary skill in the art having the benefit of the instant disclosure, so the embodiments are not limited to the slide-in oven implementation discussed herein. Moreover, the herein-described apparatus and techniques may be used in connection with other appliances, such as, for example, a dishwasher appliance.

As shown in the FIG. 1, the extending rack 20 may be used in a home oven or cooking appliance 10, such as but not limited to a slide-in cooking range, having a housing 13 and the cooking compartment 12, such as a baking oven, convection oven, steam oven, warming drawer and the like, in the housing 13 and accessible through the door 16 in the front of the housing 13. In the cooking appliance 10 shown in FIG. 1, the housing 13 may have a one or more cooking compartments 12 (e.g. single or double oven). It should be understood that the one or more cooking compartments 12 and/or burners 14 may be heated by gas, electric, hybrid of gas and electric, or combination of heat sources thereof. One application of an embodiment of the cooking appliance may be for a general purpose kitchen oven. The rack 20 may be adapted to engage the interior of the cooking compartment or portions of the cooking appliance. The cooking compartment 12 and/or opening 12*a* may also be defined by at least a top wall 12*b*, a bottom wall 12*c*, and at least two side walls 12*d* interconnecting the top and bottom walls. Portions of the outer periphery 22 or lateral edges 23 of the rack 20 may be pivotably coupled to the linkage members 30, 130 adjacent to or pivotably coupled to the side walls or sides 12*d*.

In some implementations, the rack 20 may include the wire rack or shelf pivoting relative to the compartment 12 from the lowered position to the raised position. One or more linkage members or arms 30, 130 pivotably couple the rack 20 to the cooking compartment 12. In the one embodiment shown, a first linkage member 30*a* and a second linkage member 30*b* engage each side 23 of the rack 20, respectively. The first and second linkage members 30*a*, 30*b* may extend from adjacent the top wall 12*b* of the compartment 12 to adjacent the bottom wall 12*c* of the compartment 12. The first and second linkage members may be substantially parallel to the side wall 12*d*. The linkage members 30, 130 (e.g. one or more members) may pivot between one or more positions from the lowered position to the raised position of the rack. It should be understood that the linkage members may be a variety of sizes, shapes, quantities, and constructions and still be within the scope of the invention.

In some embodiments, one or more cams 40, 140 may pivot the rack 20. As shown in FIGS. 1-3B, the one or more cams 40, 140 may force or drive against the one or more linkage members 30, 130 to pivot the rack 20 between the raised and lowered positions. The cam or inner cam 40, 140 may be located within the interior of the compartment 12. The cam 40, 140 may pivot (e.g. about a pivot axis P1) between at least a first position (FIG. 3A) when the rack 20 is in the lowered positions and a second position (FIG. 3*b*) in the raised position of the rack 20. Cam 40, 140 may engage, pivot, or cam against the linkage member 30, 130 or more specifically a cam receiver or cam receiving surface 32 or one or more surfaces of the one or more linkage members. The cam receiver 32 and/or linkage member follow the cam 40 between its pivot positions. In the one embodiment shown, the cam receiver 32 may be a slot 33 within an outer periphery of the one or more linkage members (e.g. 30*a* and/or 30*b*). It should be understood that the cam and/or cam receiver may be a variety of quantities, shapes, sizes, positions, and constructions and still be within the scope of the invention.

In some implementations, the one or more linkage members 30, 130 may include one or more cam receivers 32. The cam receiver 32 may be positioned away from or spaced a distance from the pivot axis P1 of the linkage member 30, 130 (e.g. 30*a*) and the side wall 12*d*. The cam receiver 32 may be adjacent the linkage member end opposite the end adjacent to or pivotably coupled to the rack 20. The pivot axis P1, between the linkage member and the side wall, may be positioned between the cam receiver 32 and the rack 20. The cam receiver 32 may be arcuate in shape and/or positioned on the forward side/periphery of the linkage member 30*a*. The cam 40, 140 applies a force/torque spaced (e.g. radially) from the pivot axis P1 of the linkage member 30, 130 in a circumferential/tangential direction about the pivot axis P1 or rotational axis R of the drive shaft 50, 150.

In some embodiments, the one or more cams 40, 140 may be pivoted at a radius from a rotational axis R. The cam 40, 140 may be spaced from the rotational axis R. The cam 40, 140 may be a cylinder, cylindrical pin, or cylindrical/arcuate in shape in some embodiments. One or more shafts 50, 150 may include the cam/pin 40, 140 spaced radially outward from the shaft body. The shaft 50, 150 may extend through the side wall 12*d* from the exterior to the interior of the compartment 12. The shaft 50, 150 may include one or more bushings 51 to allow rotation within the side walls 12*d* or mounting brackets (e.g. internal and/or external flange/bracket). The shaft 50, 150 may include a radially extending arm 52 extending outward from the shaft. The arm 52 may be attached to the shaft or body at one/proximal end 52*a* with the other/distal end 52*b* spaced therefrom may be the cam 40, 140. The cam 40, 140 or cylinder may axially extend from the shaft/arm in the same rotational axis direction away from the side wall 12*d* inwardly into the compartment 12.

In some implementations, one or more drive mechanisms 60 may raise and/or lower the rack 20. In the one embodiment shown, one or more motors 61 may be used to rotate the one or more drive shafts 50, 150 and/or pivot the one or more cams 40, 140 against the one or more linkage members 30, 130. The motor 61 may be a gear motor as is shown in the one embodiment. Although one motor 61 is shown to drive both shafts 50, 150 and/or cams 40, 140 on opposing sides of the compartment 12, it should be understood that two or more motors and/or drive mechanisms may be used. Moreover, although two cams and/or cam receivers are used as shown, it should be understood a variety of quantities and positons may be used and still be within the scope of the invention. The drive mechanism may be a variety of quantities, locations, and constructions and still be within the scope of the invention. For example, the drive mechanism may be a linear actuator in some embodiments.

Figure 2:
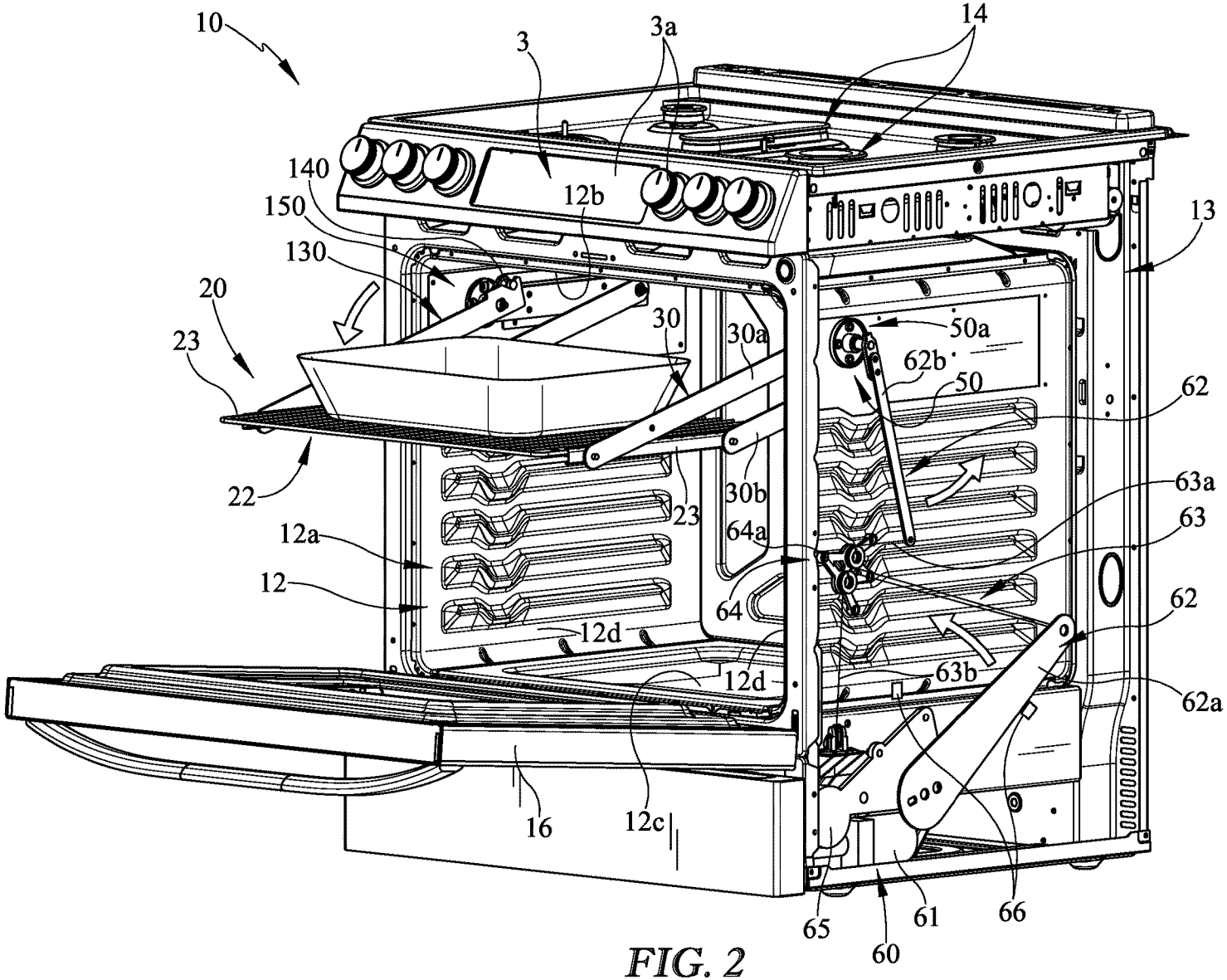
FIG. 2 is a perspective view of the rack embodiment of FIG. 1 in the raised position in a forward or deployed position through a front opening of the cooking appliance.
Figure 3B:
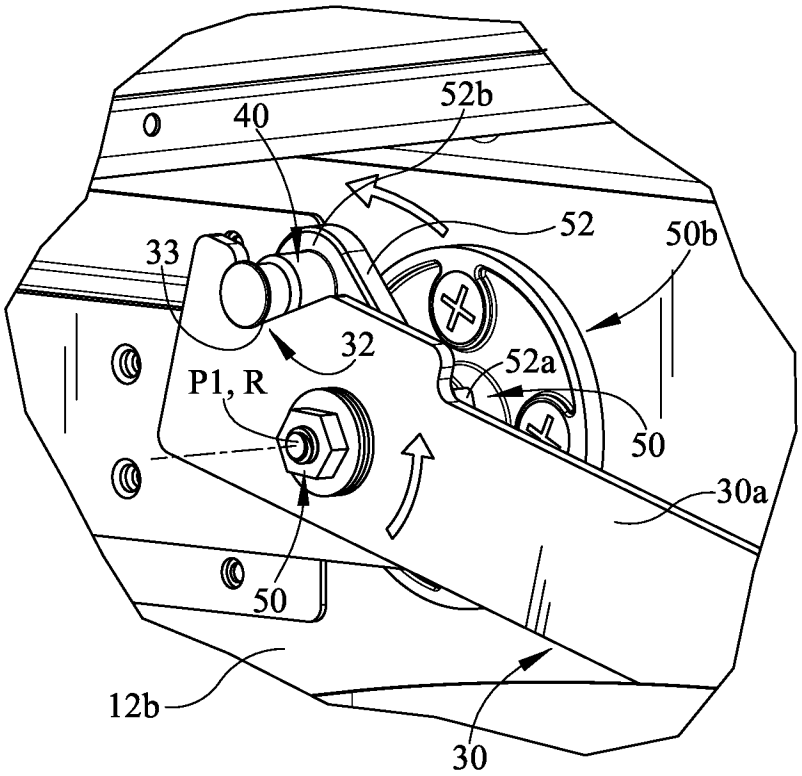
FIG. 3B is an enlarged perspective view of the rack embodiment of FIG. 3A when in the raised position.
Figure 3A:
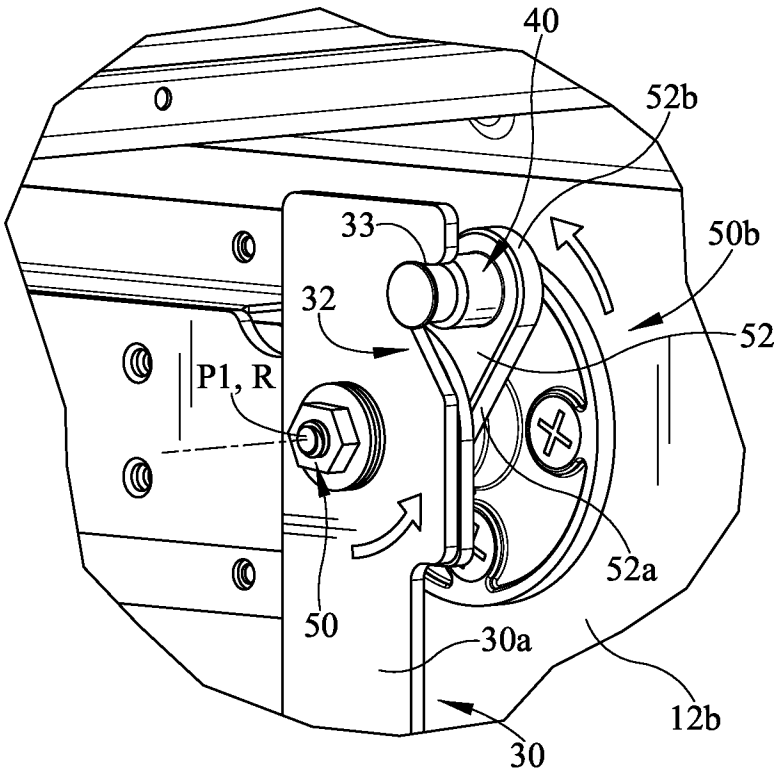
FIG. 3A is an enlarged perspective view of the rack embodiment of FIG. 1 interior of the cooking compartment when in the lowered position.
Figure 4:
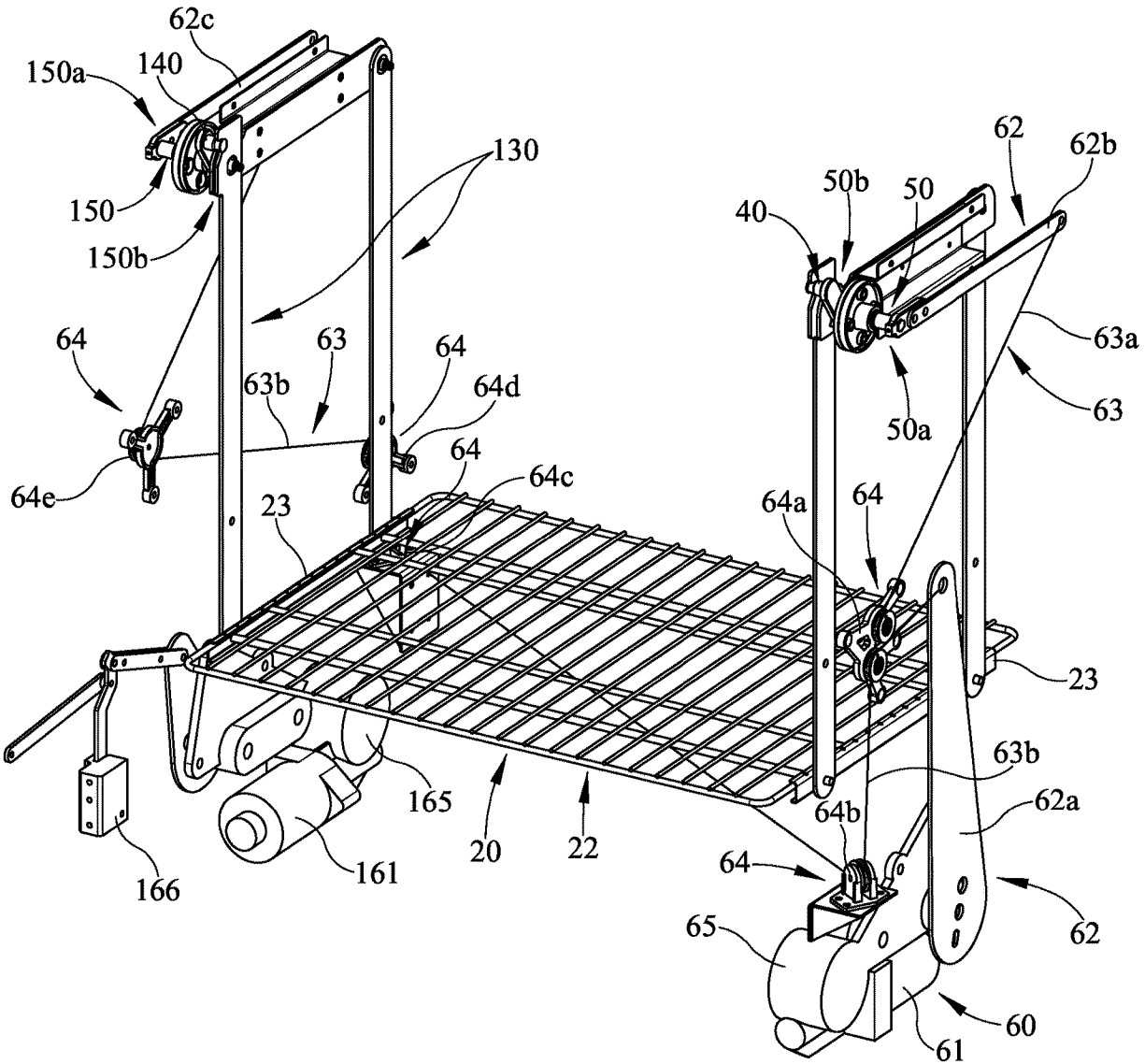
FIG. 4 is the oven rack system of the embodiment of FIG. 1.
Figure 5:
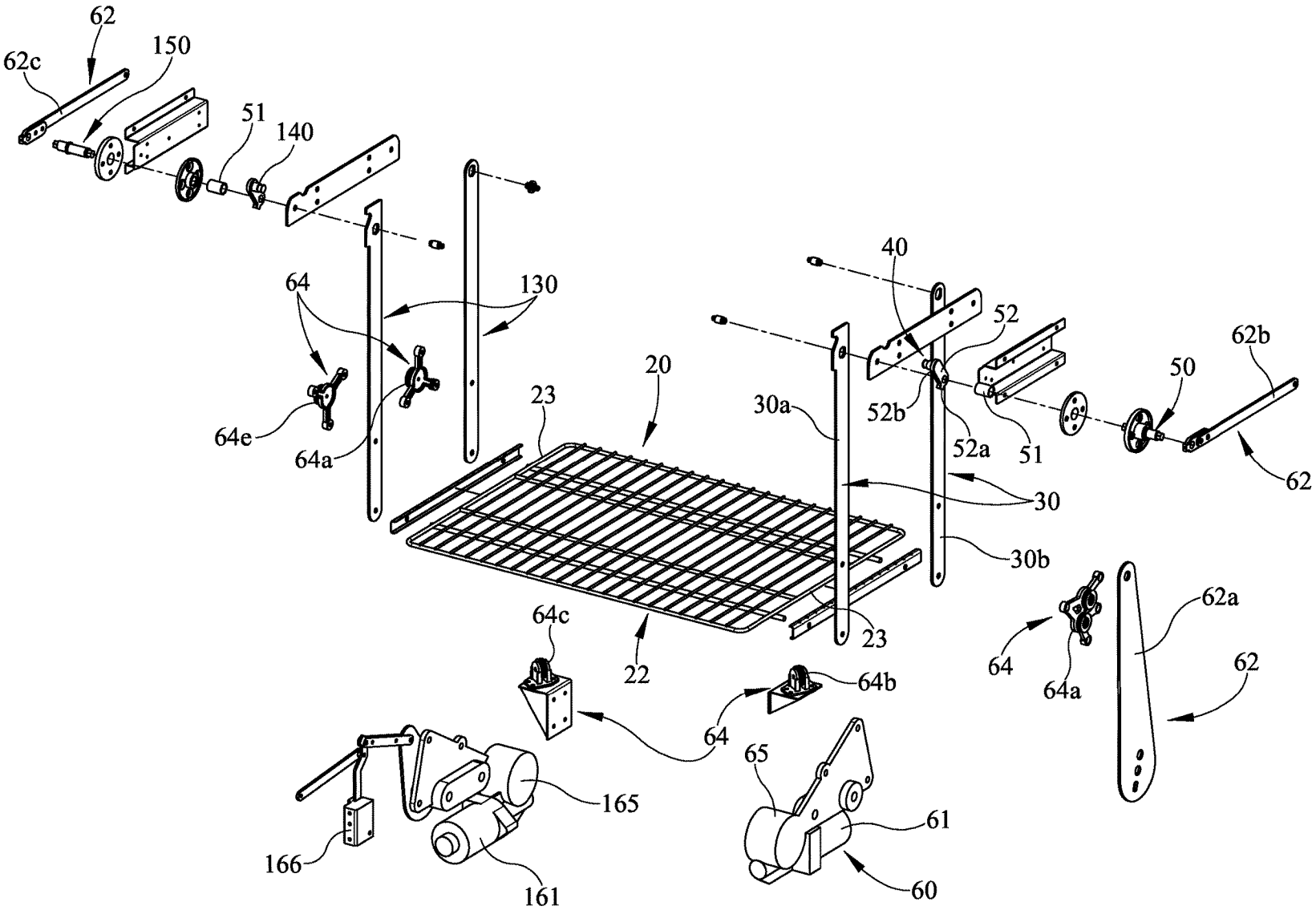
FIG. 5 is an exploded perspective view of the embodiment of FIG. 4 with the cables removed.

In some embodiments, one or more lever arms 62, one or more cables 63 and/or one or more pulleys 64 may be used to connect the one or more drive mechanisms 60 (e.g. motor) to the one or more cams 40, 140 and/or oven rack 20. A first lever arm 62*a* may be connected or affixed to the motor 61 exterior to the compartment 12. A first cable 63*a* may connect the first lever arm 62*a* to a second lever arm 62*b* secured or fixed to the drive shaft 50/cam 40. The second lever arm 62*b* may be affixed to an outside or first end 50*a* of the shaft 50 or shaft body (e.g. outside of the compartment) and the cam 40 may be affixed to an inside or second end 50*b* of the shaft 50 (e.g. inside of the compartment). The motor 61 pivots the first lever arm 62*a* thereby pulling the first cable 63*a* along with the following lever or second lever arm 62*b* to rotate the drive shaft 50 and pivot first cam 40. As illustrated in FIGS. 1 and 2, the second lever arm 62*b* and the first lever arm 62*a* may pivot in opposing rotational directions. The first cable 63*a* may be routed via one or more pulleys 64 (e.g. first pulley 64*a*) between the one or more levers (e.g. first lever arm 62*a* and second lever arm 62*b*).

In the one embodiment shown, a second cam 140, if used, may be used to reposition the rack 20. The second cam 140 may be positioned on the other side wall 12*d* of the compartment 12. The motor 61 or another drive mechanism may raise the over rack 20 via the second linkage members 130 with the second cam 140/second drive shaft 150 along with the first cam 40. The motor 61 may pivot the second cam 140 against one or more of the second linkage members 130 to correspondingly pivot the rack 20 and second linkage members 130 between the raised and lowered positions. A second cable 63*b* may connect the first lever arm 62*a* to a third lever arm 62*c* secured or fixed to the second drive shaft 150/cam 140. The third lever arm 62*c* may be affixed to an outside or first end of the shaft 150 or shaft body (e.g. outside of the compartment) and the cam 140 may be affixed to an inside or second end of the shaft 150 (e.g. inside of the compartment). The motor 61 pivots the first lever arm 62*a* thereby pulling the second cable 63*b* along with the following lever or third lever arm 62*c* to rotate the second drive shaft 150 and pivot the second cam 140. The third lever arm 62*c* and the first lever arm 62*a* may pivot in the same rotational directions. The second cable 63*b* may be routed via one or more pulleys 64 (e.g. first pulley 64*a*, second pulley 64*b*, third pulley 64*c*, fourth pulley 64*d*, fifth pulley 64*e* etc.) between the one or more levers (e.g. first lever arm 62*a* and third lever arm 62*c*).

In some implementations, a clutch 65 may be used to lock the oven rack in one or more positions. For example, the clutch (e.g. electromagnetic), if used, may lock the motor 61/rack 20 in the raised position and/or lowered position. The clutch may engage/disengage the motor from driving the shaft/cam/rack.

In some implementations, one or more limit switches 66 may be used to signal the one or more positions of the oven rack or portions of the oven rack system. As shown in FIGS.

1 and 2, the one or more limit switches 66, if used, may signal if the rack 20 may be in the raised and/or lowered positions.

In some implementations, a clutch 165 may be used to lock the oven door in one or more positions. For example, the clutch (e.g. electromagnetic), if used, may lock the motor 161/door 16 in the closed position and/or opened position. The clutch may engage/disengage the motor from driving the door 16.

In some implementations, one or more limit switches 166 may be used to signal the one or more positions of the oven door 16. The one or more limit switches 166, if used, may signal if the door 16 may be in the closed and/or opened positions.

In various embodiments, the rack 20 may be raised and/or lowered between positions manually and/or automatically. Moreover, in some embodiments, the door 16 may be raised and/or lowered between positions manually and/or automatically. The rack/door system may be operated by voice commands and/or other controls. In some embodiments, the rack system or rack 20 may be raised automatically when the door 16 is opened. In various embodiments, the rack system or rack 20 may be lowered when the door 16 is closed. In other embodiments, the door 16 may be automatically and/or manually opened and/or closed. As shown in FIGS. 4-8, a motor 161 and/or controls, if used, may open/close the door.

Figure 7:
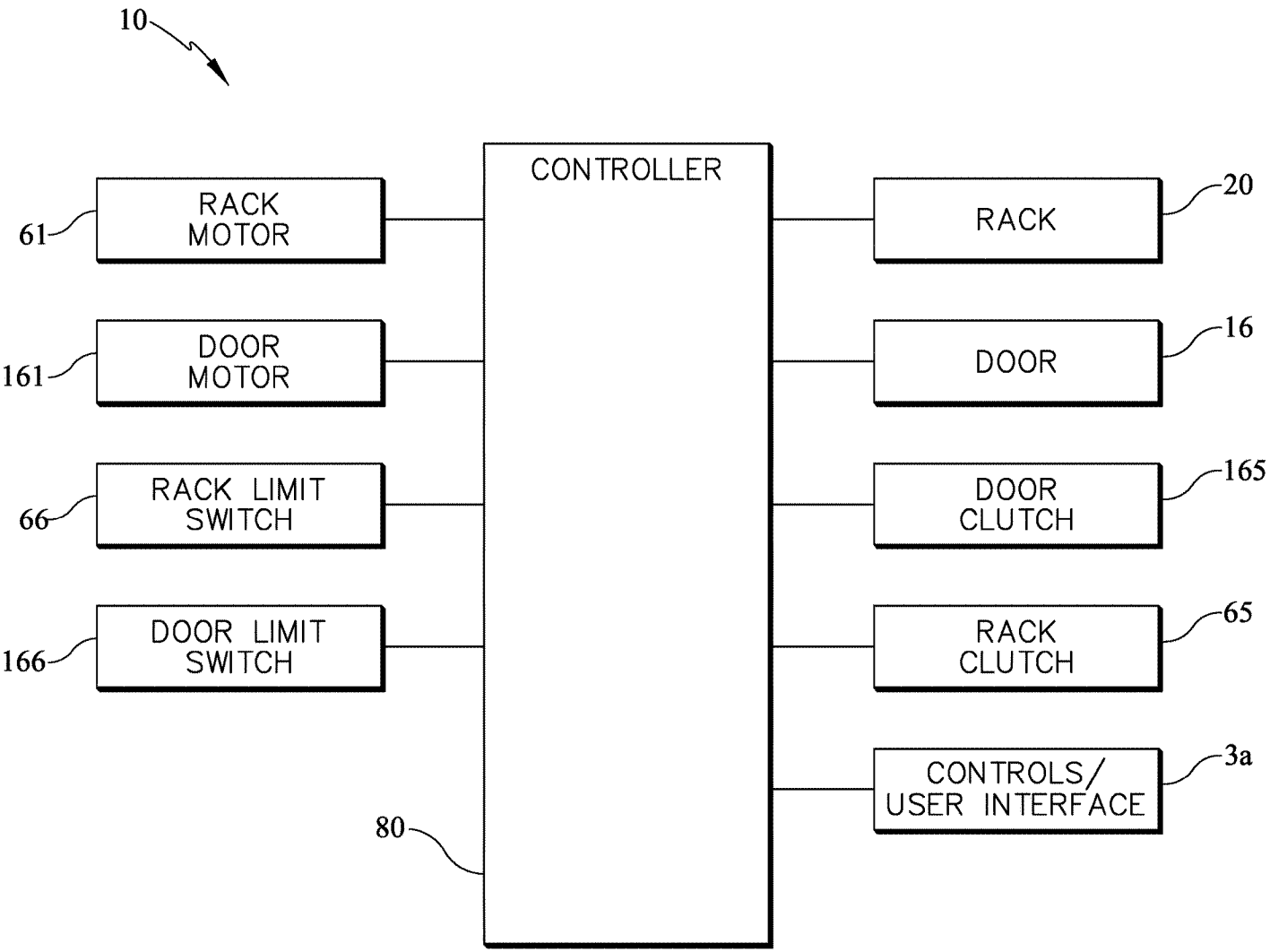
FIG. 7 is a block diagram of an example control system for the cooking appliance of FIG. 1.

Now turning to FIG. 7, appliance 10 may be, in whole or in part, under the control of a controller 80 that receives inputs from a number of components and drives a number of components in response thereto. Controller 80 may, for example, include one or more processors and a memory (not shown) within which may be stored program code for execution by the one or more processors. The memory may be embedded in controller 80, but may also be considered to include volatile and/or non-volatile memories, cache memories, flash memories, programmable read-only memories, read-only memories, etc., as well as memory storage physically located elsewhere from controller 80, e.g., in a mass storage device or on a remote computer interfaced with controller 80.

As shown in FIG. 7, controller 80 may be interfaced with various components, including the aforementioned motors 61/161, clutches 65/165, rack 20, door 16, limit switches 66/166, control panel 3 and/or controls 3*a* (e.g. manual or voice). In addition, controller 80 may be coupled to a user interface or controls 3*a* including various input/output devices such as knobs, dials, sliders, switches, buttons, lights, textual and/or graphics displays, touch screen displays, speakers, image capture devices, microphones, cameras, etc. for receiving input from and communicating with a user, e.g., as may be disposed in a control panel 3. In some embodiments, controller 80 may also be coupled to one or more network interfaces, e.g., for interfacing with external devices via wired and/or wireless networks such as Ethernet, Bluetooth, NFC, cellular, and other suitable networks. Additional components may also be interfaced with controller 80, as will be appreciated by those of ordinary skill having the benefit of the instant disclosure. Moreover, in some embodiments, at least a portion of controller 80 may be implemented externally from the appliance, e.g., within a mobile device, a cloud computing environment, etc., such that at least a portion of the functionality described herein is implemented within the portion of the controller 80 that is externally implemented.

In some embodiments, controller 80 may operate under the control of an operating system and may execute or otherwise rely upon various computer software applications, components, programs, objects, modules, data structures, etc. In addition, controller 80 may also incorporate hardware logic to implement some or all of the functionality disclosed herein. Further, in some embodiments, the sequences of operations performed by controller 80 to implement the embodiments disclosed herein may be implemented using program code including one or more instructions that are resident at various times in various memory and storage devices, and that, when read and executed by one or more hardware-based processors, perform the operations embodying desired functionality. Moreover, in some embodiments, such program code may be distributed as a program product in a variety of forms, and that the invention applies equally regardless of the particular type of computer readable media used to actually carry out the distribution, including, for example, non-transitory computer readable storage media. In addition, it will be appreciated that the various operations described herein may be combined, split, reordered, reversed, varied, omitted, parallelized and/or supplemented with other techniques known in the art, and therefore, the invention is not limited to the particular sequences of operations described herein.

Figure 8:
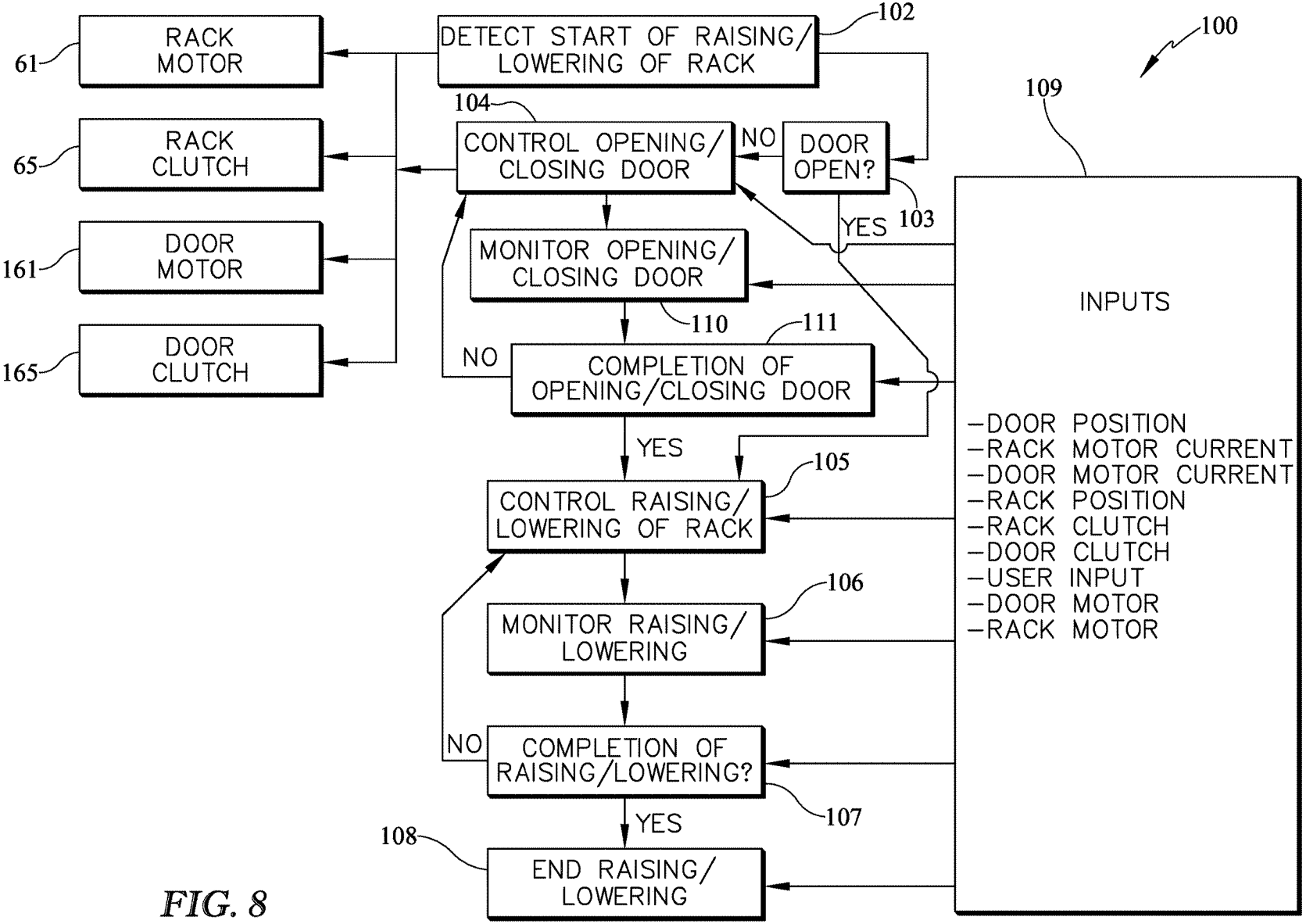
FIG. 8 is a flow chart illustrating an example sequence of operations of the raising/lowering cycle or phase of the oven rack in the cooking appliance of FIG. 1.

Now turning to FIG. 8, and with continuing reference to FIGS. 1-7, one sequence of operations 100 for performing the rack cycle that raises/lowers the rack 20 of the appliance 10. Blocks 102-111 may determine the cycle criteria based upon a variety of outputs from the sensors and other inputs that are shown, by example only, in block 109. The cycle or raising/lowering of the rack 20 may be started (block 102) in a variety of ways, e.g., pushing one or more buttons on the control panel 3, opening the door/closing the door 16, user interface/input, voice commands, user gestures, etc. A loop in blocks 105-107 may control the lowering/raising of the rack 20 and monitors the raising/lowering, for example, limit switches, duration, and user input (block 109), etc., and correlating them with the selected, e.g., known, preset, manually determined, or predetermined, raising/lowering completion status (block 107). Once the completion criteria (block 107) is met, the raising/lowering cycle may then pass to block 108 to end the cycle, respectively. Ending of the cycle (block 108) may include an indicator, alarm, message, text, visual and/or audio, or the like to make the user aware of the end of the cycle. Another loop, if used, in blocks 104, 110, and 111 controls the opening/closing of the door 16 and monitors the opening/closing, for example, limit switches, duration, and user input (block 109), etc., and correlating them with the selected, e.g., known, preset, manually determined, or predetermined, opening/closing completion status (block 111).

It should be understood to one of ordinary skill that the rack 20 may be operated by methods in addition to or instead of manually operated. Moreover, the drive mechanism may operate the rack towards the deployed/raised position and/or the stowed/lowered position, and a variety of positions therebetween.

While several embodiments have been described and illustrated herein, those of ordinary skill in the art will readily envision a variety of other means and/or structures for performing the function and/or obtaining the results and/or one or more of the advantages described herein, and each of such variations and/or modifications is deemed to be within the scope of the embodiments described herein. More generally, those skilled in the art will readily appreciate that all parameters, dimensions, materials, and configurations described herein are meant to be exemplary and that the actual parameters, dimensions, materials, and/or configurations will depend upon the specific application or applications for which the teachings is/are used. Those skilled in the art will recognize, or be able to ascertain using no more than routine experimentation, many equivalents to the specific embodiments described herein. It is, therefore, to be understood that the foregoing embodiments are presented by way of example only and that, within the scope of the appended claims and equivalents thereto, embodiments may be practiced otherwise than as specifically described and claimed. Embodiments of the present disclosure are directed to each individual feature, system, article, material, and/or method described herein. In addition, any combination of two or more such features, systems, articles, materials, and/or methods, if such features, systems, articles, materials, and/or methods are not mutually inconsistent, is included within the scope of the present disclosure.

All definitions, as defined and used herein, should be understood to control over dictionary definitions, definitions in documents incorporated by reference, and/or ordinary meanings of the defined terms.

The indefinite articles "a" and "an," as used herein in the specification and in the claims, unless clearly indicated to the contrary, should be understood to mean "at least one."

The phrase "and/or," as used herein in the specification and in the claims, should be understood to mean "either or both" of the elements so conjoined, i.e., elements that are conjunctively present in some cases and disjunctively present in other cases. Multiple elements listed with "and/or" should be construed in the same fashion, i.e., "one or more" of the elements so conjoined. Other elements may optionally be present other than the elements specifically identified by the "and/or" clause, whether related or unrelated to those elements specifically identified. Thus, as a non-limiting example, a reference to "A and/or B", when used in conjunction with open-ended language such as "comprising" can refer, in one embodiment, to A only (optionally including elements other than B); in another embodiment, to B only (optionally including elements other than A); in yet another embodiment, to both A and B (optionally including other elements); etc.

As used herein in the specification and in the claims, "or" should be understood to have the same meaning as "and/or" as defined above. For example, when separating items in a list, "or" or "and/or" shall be interpreted as being inclusive, i.e., the inclusion of at least one, but also including more than one, of a number or list of elements, and, optionally, additional unlisted items. Only terms clearly indicated to the contrary, such as "only one of" or "exactly one of," or, when used in the claims, "consisting of," will refer to the inclusion of exactly one element of a number or list of elements. In general, the term "or" as used herein shall only be interpreted as indicating exclusive alternatives (i.e. "one or the other but not both") when preceded by terms of exclusivity, such as "either," "one of," "only one of," or "exactly one of." "Consisting essentially of," when used in the claims, shall have its ordinary meaning as used in the field of patent law.

As used herein in the specification and in the claims, the phrase "at least one," in reference to a list of one or more elements, should be understood to mean at least one element selected from any one or more of the elements in the list of elements, but not necessarily including at least one of each and every element specifically listed within the list of elements and not excluding any combinations of elements in the list of elements. This definition also allows that elements may optionally be present other than the elements specifically identified within the list of elements to which the phrase "at least one" refers, whether related or unrelated to those elements specifically identified. Thus, as a non-limiting example, "at least one of A and B" (or, equivalently, "at least one of A or B," or, equivalently "at least one of A and/or B") can refer, in one embodiment, to at least one, optionally including more than one, A, with no B present (and optionally including elements other than B); in another embodiment, to at least one, optionally including more than one, B, with no A present (and optionally including elements other than A); in yet another embodiment, to at least one, optionally including more than one, A, and at least one, optionally including more than one, B (and optionally including other elements); etc.

It should also be understood that, unless clearly indicated to the contrary, in any methods claimed herein that include more than one step or act, the order of the steps or acts of the method is not necessarily limited to the order in which the steps or acts of the method are recited.

In the claims, as well as in the specification above, all transitional phrases such as "comprising," "including," "carrying," "having," "containing," "involving," "holding," "composed of," and the like are to be understood to be open-ended, i.e., to mean including but not limited to. Only the transitional phrases "consisting of" and "consisting essentially of" shall be closed or semi-closed transitional phrases, respectively, as set forth in the United States Patent Office Manual of Patent Examining Procedures, Section 2111.03.

It is to be understood that the embodiments are not limited in its application to the details of construction and the arrangement of components set forth in the description or illustrated in the drawings. The invention is capable of other embodiments and of being practiced or of being carried out in various ways. Unless limited otherwise, the terms "connected," "coupled," "in communication with," and "mounted," and variations thereof herein are used broadly and encompass direct and indirect connections, couplings, and mountings. In addition, the terms "connected" and "coupled" and variations thereof are not restricted to physical or mechanical connections or couplings.

The foregoing description of several embodiments of the invention has been presented for purposes of illustration. It is not intended to be exhaustive or to limit the invention to the precise steps and/or forms disclosed, and obviously many modifications and variations are possible in light of the above teaching.

The invention claimed is:

1. An oven rack system for a cooking appliance comprising:

an oven rack;

one or more linkage members pivotably coupled to the oven rack, wherein at least one linkage member includes a cam receiver;

a cam pivoting against the cam receiver of the at least one linkage member to pivot the oven rack between a stowed position and a deployed position, wherein the stowed position is lower than the deployed position;

wherein the cam receiver is a slot within an outer periphery of the at least one linkage member; and a drive shaft having the cam at one end and a lever arm positioned at an opposing end.

2. An oven rack system for a cooking appliance comprising:

an oven rack;

one or more linkage members pivotably coupled to the oven rack, wherein at least one linkage member includes a cam receiver;

a cam pivoting against the cam receiver of the at least one linkage member to pivot the oven rack between a stowed position and a deployed position, wherein the stowed position is lower than the deployed position;

a first lever arm and a second lever arm interconnected by a first cable;

a drive shaft having the cam at one end and the second lever arm positioned at an opposing end; and a motor pivoting the first lever arm to pull the first cable with the second lever arm following to rotate the drive shaft.

3. An oven rack system for a cooking appliance comprising:

an oven rack;

one or more linkage members pivotably coupled to the oven rack, wherein at least one linkage member includes a cam receiver;

a cam pivoting against the cam receiver of the at least one linkage member to pivot the oven rack between a stowed position and a deployed position, wherein the stowed position is lower than the deployed position; and a drive shaft having the cam at one end and a lever arm positioned at an opposing end, wherein the cam is cylindrical in shape.

4. The oven rack system of claim 3 wherein the at least one linkage member includes a pivot axis, and wherein the pivot axis is positioned between the cam receiver and the oven rack.

5. The oven rack system of claim 3 wherein the drive shaft includes a radially extending arm at the one end, wherein the cam is spaced radially outward from a rotational axis of the drive shaft.

6. The oven rack system of claim 3 further comprising one or more cables, the lever arm, and one or more pulleys connecting a motor to pivot the cam.

7. The oven rack system of claim 3 wherein the cam receiver is a slot within an outer periphery of the at least one linkage member.

8. A cooking appliance comprising:

a cooking compartment defined by opposing side walls;

a first drive shaft extending through at least one of the side walls, wherein the first drive shaft includes a first cam;

a plurality of first linkage members pivotably connecting the at least one side wall of the opposing side walls to a wire rack, and wherein the plurality of first linkage members and the wire rack is positionable between a lowered position within the cooking compartment and a raised position deployed from the cooking compartment;

a motor rotating the first drive shaft pivots the first cam against at least one first linkage member of the plurality of first linkage members to pivot the wire rack and the plurality of first linkage members to the raised position; and a first lever arm and a second lever arm interconnected by a first cable, wherein the second lever arm is secured to the first drive shaft, and wherein the motor pivots the first lever arm pulling the first cable with the second lever arm following to rotate the first drive shaft.

9. The cooking appliance of claim 8 wherein the at least one first linkage member includes a first cam receiving surface and a pivot axis, wherein the first cam receiving surface is spaced from the pivot axis.

10. The cooking appliance of claim 8 wherein the first cam is spaced radially outward from a rotational axis of the first drive shaft.

11. The cooking appliance of claim 8 wherein the second lever arm and the first lever arm pivot in opposing rotational directions.

12. The cooking appliance of claim 8 further comprising a second drive shaft extending through another side wall of the opposing side walls, wherein the second drive shaft includes a second cam;

a plurality of second linkage members pivotably connecting the other side wall of the opposing side walls to the wire rack, and wherein the plurality of second linkage members and the wire rack is positionable between the lowered position within the cooking compartment and the raised position deployed from the cooking compartment; and the motor rotating the second drive shaft pivots the second cam against at least one second linkage member of the plurality of second linkage members to pivot the wire rack and the plurality of second linkage members to the raised position.

13. The cooking appliance of claim 12 further comprising a third lever arm secured to the second drive shaft and connected to the first lever arm by a second cable, and wherein the motor pivots the first lever arm pulling the second cable with the third lever arm following to rotate the second drive shaft.

14. A cooking appliance comprising:

a cooking compartment having a rack positionable between a lowered positioned within the cooking compartment and a raised position deployed from the cooking compartment;

at least one motor;

one or more linkage members pivotably coupled to the rack;

at least one drive shaft extending through a side wall of the cooking compartment and having an outside end and an inside end, wherein the inside end includes a cam and the outside end includes a lever arm;

wherein at least one linkage member of the one or more linkage members includes a cam receiver, and wherein the cam receiver is a slot within an outer periphery of the at least one linkage member; and wherein the at least one motor pivots the lever arm and the cam about a rotational axis of the at least one drive shaft, wherein the cam engages the cam receiver of the at least one linkage member thereby pivoting the one or more linkage members and the rack to the raised position.

15. The cooking appliance of claim 14 further comprising at least one limit switch to signal at least one position of the rack.

16. The cooking appliance of claim 14 further comprising a clutch locking the rack in the raised positon.

17. The cooking appliance of claim 14 further comprising a cable connecting the at least one motor with the lever arm, wherein the cable pivots the lever arm.

18. The cooking appliance of claim 14 wherein the at least one linkage member includes the cam receiver and a pivot axis, wherein the cam receiver is spaced from the pivot axis.

19. The cooking appliance of claim 14 further comprising more than one of the at least one drive shafts.

* * * * *